United States Patent [19]

Masters

[11] 4,440,144

[45] Apr. 3, 1984

[54] HEATER APPARATUS AND METHOD

[76] Inventor: William E. Masters, 138 Norris Ave., Liberty, S.C. 29657

[21] Appl. No.: 181,078

[22] Filed: Aug. 25, 1980

[51] Int. Cl.[3] ..... F24C 1/14

[52] U.S. Cl. ..... 126/61; 126/58; 126/64; 126/99 D; 110/336; 236/52; 236/53

[58] Field of Search ..... 126/121, 131, 130, 114, 126/123, 126, 99 D, 285 R, 289, 290, 144, 64, 106, 108; 110/336; 236/52, 53

[56] References Cited

U.S. PATENT DOCUMENTS

| | | | |
|---|---|---|---|
| 74,270 | 2/1868 | Arden | 126/144 |
| 505,237 | 9/1893 | Sheldon | 126/131 |
| 522,364 | 7/1894 | Finley | 126/144 |
| 546,722 | 9/1895 | Weightman | 126/144 |
| 2,297,776 | 10/1942 | Kelley et al. | 126/121 |
| 3,190,279 | 6/1965 | Davis | 126/121 |
| 3,762,391 | 10/1973 | Andrews | 126/121 |
| 4,092,976 | 6/1978 | Buckner | 126/121 X |
| 4,121,560 | 10/1978 | Knight | 126/121 |
| 4,253,444 | 3/1981 | Johnson | 126/121 X |
| 4,369,761 | 1/1983 | Burnette | 126/123 |

*Primary Examiner*—Larry Jones
*Assistant Examiner*—Carl D. Price
*Attorney, Agent, or Firm*—Dority & Flint

[57] ABSTRACT

Heater apparatus is disclosed having a metal firebox in which fuel is burned and an outer ceramic enclosure having ceramic mass walls which absorb excess heat when the heater produces more heat than is required and distributes the heat gradually by radiation after the heater output becomes less than the heat stored in the ceramic mass. The ceramic mass walls are spaced from the metal firebox walls to provide air passages through which air may be circulated by means of a blower so that rapid heating may be had of the interior space when the firebox is initially fired by transferring the heat radiated from the metal walls directly into the room by forced convection. After the interior space is heated to a desired temperature, the blower may be cut off and the room may be heated more slowly at a more even temperature by radiation from the ceramic mass.

8 Claims, 6 Drawing Figures

HEATER APPARATUS AND METHOD

BACKGROUND OF THE INVENTION

Heretofore, heater stoves have been developed utilizing metal fireboxes and spaced metal walls defining air passages in which air may be circulated by a blower such as disclosed in U.S. Pat. No. 4,092,976. However, the problem arises that the metal walls radiate heat very rapidly and the heat from the fuel burned is distributed in a relatively short period of time at a high temperature. If the stove is throttled down, to spread out the burning time, combustion is incomplete and detrimental gases accumulate in the flue and chimneys which requires periodic cleaning and present a hazardous fire problem if left to accumulate. Incomplete combustion also results in inefficient use of the fuel. Furthermore, such heater stoves become very hot with or without use of a blower presenting a danger of hazardous burns to small children.

Other wood and coal burning stoves have utilized ceramic walls which absorb the heat from the fuel being burned and distribute the heat by radiation at a lower temperature. However, the initial response of such stoves is very long during initial heatup, and provide adequate heat only after the fire has burned a considerable amount of time. The combination of a firebox having metal and ceramic walls is also known which heats by natural convection and radiation. However, the initial response time is still slow. Shipping and distribution of such ceramic stoves is troublesome owing to their size and extremely heavy construction making them difficult and expensive to ship and distribute.

Accordingly, an important object of the present invention is the provision of heater stove apparatus having a rapid initial response and which, after reaching a desired temperature, may be controlled to distribute heat gradually at a low temperature for a more even distribution of heat.

Yet another important object of the present invention is to provide heater stove apparatus which distributes heat at a low temperature over a longer time interval than a conventional double-walled metal stove while affording the same degree of rapid initial response in heating an interior space.

Still another important object of the present invention is to provide wood heater stove apparatus having rapid initial response capability and thereafter gradual response capability at a low temperature without the attendant problem of incomplete combustion accumulation of detrimental gases as found in prior heater stoves.

Still another important object of the present invention is to provide a heater stove apparatus which includes an inner metal firebox and individual ceramic mass on site in a home to provide forced convection and radiant heat at an affordable cost.

Still another important object of the present invention is to provide apparatus for adapting an existing metal heater stove into a convection and radiant heater by constructing a ceramic outer shell about walls of the metal firebox, particularly, on site in a home.

SUMMARY OF THE INVENTION

It has been found according to the invention, that heater stove apparatus can be had having a rapid initial response to initially raise the temperature in an interior space to a desired level and thereafter absorb any excess heat from the fire in ceramic masses which radiate the heat gradually at a lower temperature. The apparatus includes a metal firebox enclosure provided with an outer ceramic enclosure spaced from metal walls of the firebox to provide advantageous air circulation passages between the metal and ceramic walls. A blower means is connected with the air passages to force air therethrough which removes and delivers heat rapidly radiated from the metal walls by forced convection into the room for initial heatup. Thereafter, the blower operation may be terminated and the excess heat from the firebox is absorbed by the ceramic mass of the ceramic enclosure which radiate heat gradually at a low temperature providing a more even and comfortable distribution of heat in the interior space. In a unique and advantageous form of the invention, the ceramic enclosure may be constructed about a metal firebox on site in the home by the homeowner so as to reduce shipping and purchase cost which lends itself to adaptation of existing metal heater stoves into a stove having dual mode operating capability.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
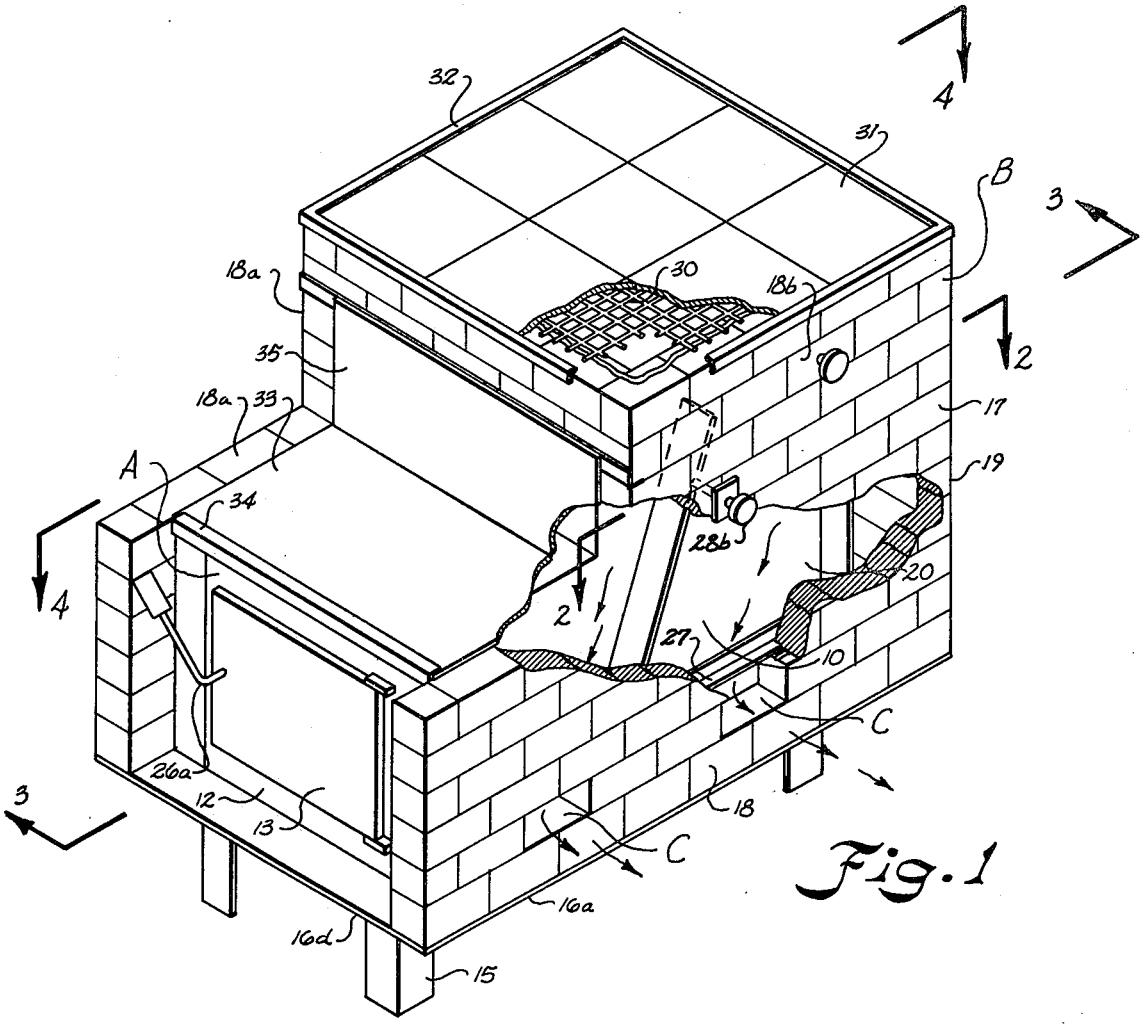
FIG. 1 is a perspective view with parts cut away illustrating heater stove apparatus constructed according to the invention.
Figure 2:
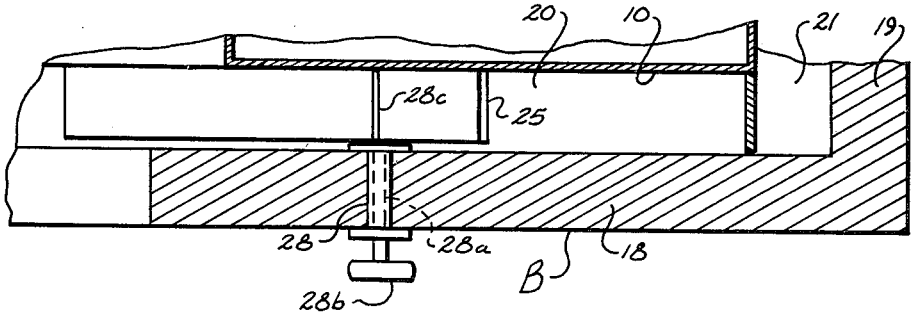
FIG. 2 is a partial sectional view taken along line 2—2 of FIG. 1.
Figure 3:
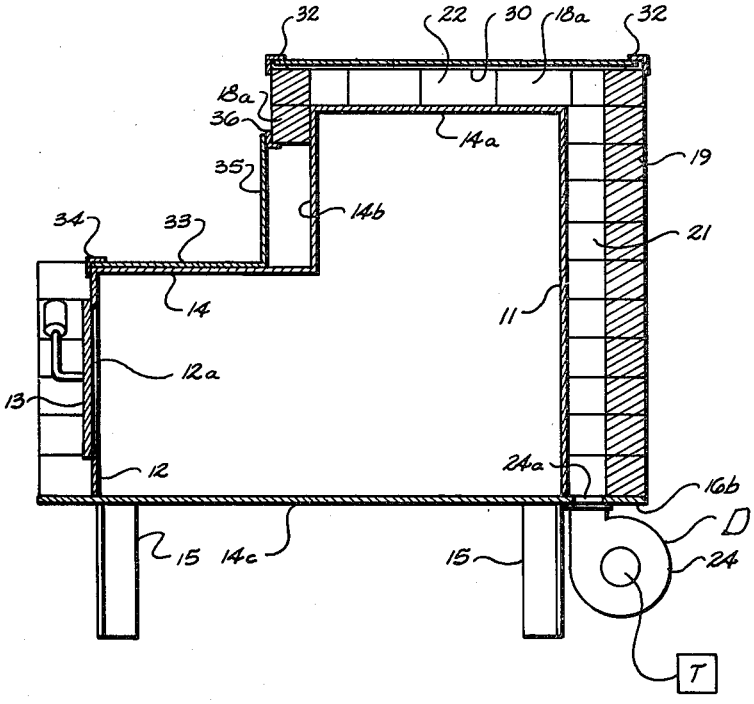
FIG. 3 is a sectional view taken along line 3—3 of FIG. 1.
Figure 4:
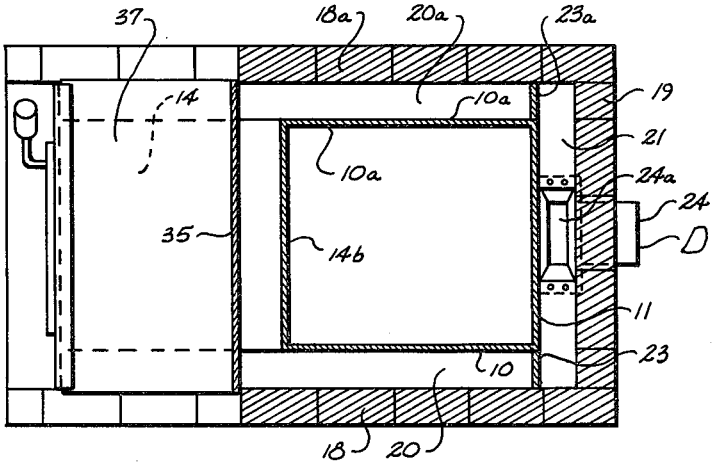
FIG. 4 is a sectional view taken along line 4—4 of FIG. 1.

The invention relates to fuel burning heater apparatus, particularly wood and coal burning heater stoves for heating an interior space of the type having a metal firebox A defined by spaced side walls, top and bottom walls, and rear walls being integrally joined and the front wall having a closable opening through which wood and the like may be loaded. The apparatus includes a ceramic shell B partially enclosing the metal firebox with ceramic walls of the shell being spaced from walls of the firebox defining air passages therebetween. Air outlets C are provided in the air passages for delivering air outwardly into the interior space. Heat transfer control means for controlling transfer of heat by either forced convection or radiation comprises blower means D connected with the passages for circulating and forcing air outwardly through the air outlets and control means controlling the blower so that heat initially radiated from the metal walls may be delivered by the blower to heat the interior space rapidly by forced convection until a desired temperature is reached whereupon the blower may be terminated in its operation to allow excess heat to be absorbed by the ceramic masses and gradually radiated at a low temperature providing a more uniform and comfortable distribution of heat in the interior space.

Referring now in more detail to the drawings, the metal firebox A is illustrated as having side walls 10 and 10*a*, back wall 11, and front wall 12 having an opening 12*a* which is closable by a pivotable door 13 having a handle 26*a*. The metal firebox may have any form and shape, and, as illustrated, includes a step stove design having top portions 14 and 14*a* which are connected by means of a step front wall 14*b*. This shape lends itself to a very attractive and practical heater stove apparatus according to the invention. The normal flue arrangement may be provided at any desired location in the firebox in a conventional manner.

A lower rectangular frame having legs 16*a*, 16*b*, 16*c* and 16*d* surrounds the metal firebox. The frame legs 16*a*, 16*b*, 16*c* and 16*d* support ceramic mass units 17 which are illustrated in the form of conventional bricks such as used in home construction to build a wall exposure for passive solar heating. However, any suitable dark ceramic makterial having adequate thermal mass to absorb heat may be utilized. As illustrated in FIG. 1, frame legs 16*a*, 16*b*, 16*c* and 16*d* may be integrally made with stove firebox A and attached such as by welding. In other embodiments, frame legs 16*a*, 16*b*, 16*c* and 16*d* may be attached separately at an installation site such as by using suitable brackets and bolts. The brick may be laid and stacked by conventional manner to form ceramic walls 18 and 18*a* and back wall 19. It has been found that applying a thin bead of silicon caulking along the center of the brick is highly advantageous in sealing the air passages while allowing the bricks to be separated and dismantled for later transportation and moving. This assembly also results in an attractive cosmetic appearance. While it is to be understood that any type ceramic material or thermal mass which absorbs heat and releases it slowly may be utilized, the bricks as illustrated are advantageously employed since they may be purchased separately and constructed on the frame legs 16*a*, 16*b*, 16*c* and 16*d* in a manner according to the invention which provides an economical and practical construction.

The bricks are spaced from the metal walls 10, 10*a*, and 11 to provide respective side air passages 20 and 20*a* and rear air passage 21. The bricks or other ceramic mass walls are in close proximity thereto to absorb and radiate heat for effective heating of an interior room space in the radiation mode of heating. A top air passage 22 is also provided.

A pair of side baffle plates 23 and 23*a* extend laterally from the sides 10 and 10*a*, respectively, and terminate vertically short of the top 14*a* of the firebox such that air circulated by blower means D, in the form of a horizontal cage blower 24, is forced upwardly over substantially the entire back side 11 of the firebox and over the baffles. As such, baffles 23 and 23*a* further define side passages 20, 20*a*, and rear passage 21. Blower 24 communicates with back passage 21 by means of an opening 24*a* provided in leg 16*b* of frame 16 to which blower 24 may be attached by bolts. In this manner, thorough heat exchange contact with the back wall of the stove is had. Thereafter, air circulates over the baffles and down over the sides 10*a* and 10 where it is directed by a pivotable vane 25, having a side edge 26, downwardly through the air passages 20*a* and 20 and outwardly through air outlets C provided by spaces between bricks.

The pivotal vane 25 is mounted by means of a sleeve 28 through which a pivotable shaft 28*a* is rotatably received having a knob 28*b* for turning shaft 28*a* and pivoting vane 25. The sleeve may be fitted and cemented between a pair of adjacent bricks. Vane 25 is attached, such as by welding, to an extension 28*c* of shaft 28*a*, and may be adjusted to direct the air as desired.

The air outlet C may be formed by omitting a brick at a desired location. The location of air outlets C may thus be varied to suit the needs of a particular application. For example, in FIG. 1, the stove may be positioned in a corner with side wall 18*a* adjacent air interior wall with no outlets C and with outlets in side 18. A top span flange 27 may be provided for the top brick over the air outlet.

The top portion of the outer enclosure B may include a portion over the top 14*a* of the firebox which includes a first layer of expanded metal 30, over which ceramic tiles 31 may be placed and then held in place by means of a rectangular frame cap 32 which fits over the exposed edges of the ceramic tiles and the bricks stacked therebeneath. In this manner, the air space 22 is provided and the ceramic tiles 31 provide a surface which radiates heat upwardly at a low and even rate and which may be utilized to maintain food and beverages warm. The remaining top of the outer enclosure may include a ceramic tile 33 which overlies the top portion 14 of the metal firebox and a protective rail cap 34. Joining the ceramic tile piece 33 is a vertical ceramic tile piece 35 which is provided with a flange 36 which supports two layers of bricks to complete the ceramic enclosure. It is to be understood that other forms and constructions may be had for completing the ceramic enclosure walls 18, 18*a*, and 19.

Figure 5:
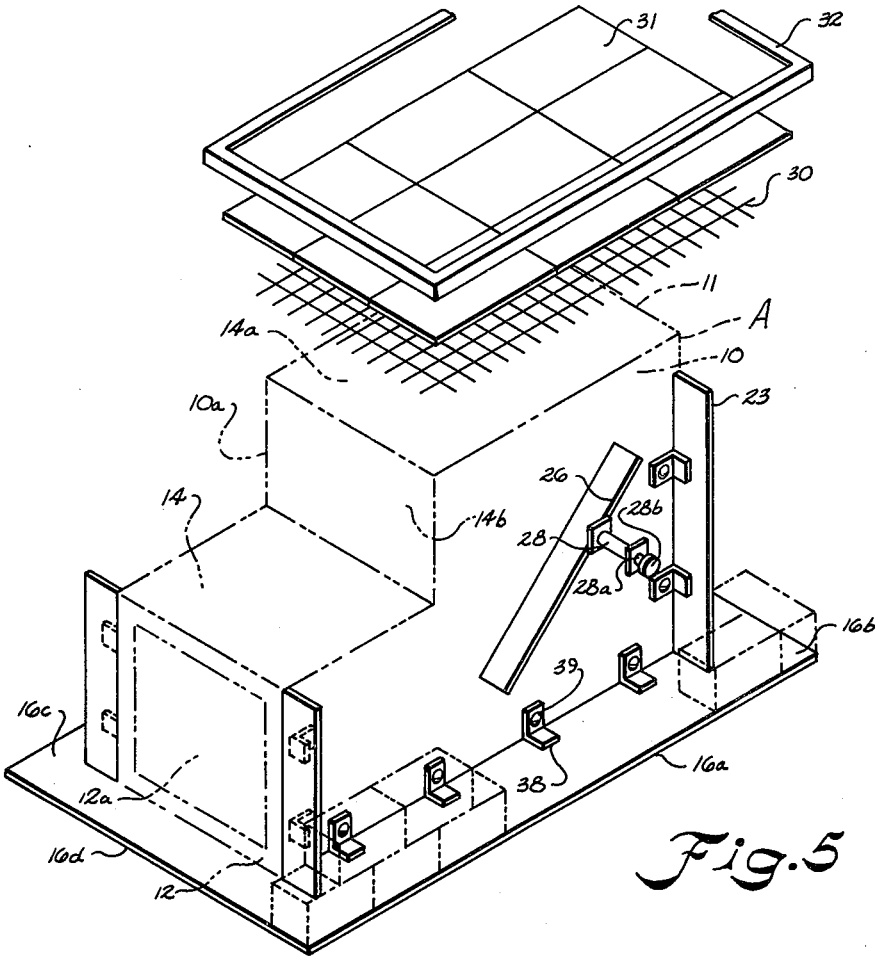
FIG. 5 is a perspective view illustrating apparatus for adapting a metal stove into stove apparatus having dual mode operational capability according to the invention.

As illustrated in FIG. 5, an advantageous form of the invention is illustrated wherein the apparatus according to the invention may be provided in the form of a conversion assembly whereby an existing metal firebox stove may be adapted in structure and function according to the invention. As illustrated, the rectangular frame 16 may be provided in the four-leg form, individually or unitarily, which is bolted to a bottom of the firebox by means of suitable brackets 38 and bolts or rivets 39, or other suitable attachment means may be provided as required. Alternately, attachment to legs 15 may be had by providing suitable brackets. Baffles 23*a* and 23 may then be suitably attached by bolts and brackets as shown as well as front side plates. The above described enclosure structure B may be supplied in kit form or purchases separately.

Figure 6:
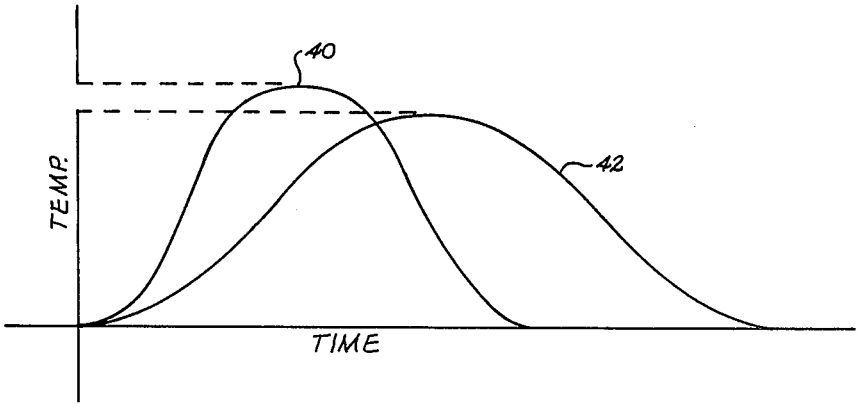
FIG. 6 is a graph illustrating heating performance of a stove constructed according to the present invention as compared to conventional stoves.

FIG. 6 illustrates the heating and temperature performance of woodburning apparatus constructed according to the invention as compared to conventional wood burning apparatus wherein line 40 represents the temperature heat curve for a conventional metal stove having a double wall construction and curve 42 represents the performance of a stove constructed according to the present invention. As can be seen, the apex of the curve 42 will not normally reach the high level of the apex of the curve 40 for the all-metal stove because the ceramic mass dampens the peak. However, the initial response time for reaching normal interior space temperatures is comparable but heat is distributed over a longer time interval from a stove constructed according to the invention as represented by curve 42 since the ceramic mass absorbs excess heat from the firebox and will continue to radiate heat more gradually at a lower temperature as compared to the metal walls of a conventional stove with or without a blower. The side walls of the metal stove may reach temperatures up to 1,000 degrees F. while the ceramic outer walls of the stove constructed according to the invention will have a much lower temperature avoiding hazardous burns to small children. The illustrated curves assumes burning a given fuel load under best conditions for possible complete combustion.

In operation, control of blower 24 may be had by a conventional thermostatic switch T which terminates blower operation after reaching a desired room temperature by forced convection. Thereafter, excess heat will be absorbed by the ceramic masses and distributed gradually by radiation providing room heating at uniform temperatures for a given fuel load burning at complete combustion conditions. Alternately, blower 24 may be controlled by manual switching.

Certain bricks 18*b* may be provided loosely assembled at upper wall locations for removal to provide heat transfer by natural convection.

While a preferred embodiment of the invention has been described using specific terms, such description is for illustrative purposes only, and it is to be understood that changes and variations may be made without departing from the spirit or scope of the following claims.

What is claimed is:

1. Fuel burning heater apparatus for heating an interior room space of a building of the type having a metal firebox defined by spaced sidewalls, top and bottom walls, and spaced front and rear walls, said walls being integrally joined and said front wall having a closable opening through which fuel may be loaded, wherein said heater apparatus comprises:

a ceramic enclosure enclosing at least said side and back metal walls;

said ceramic enclosure having ceramic mass walls spaced from said metal walls defining heat transfer air passages therebetween into which heat from said metal walls is transferred and which may thereafter be transferred into said interior room space by forced air flow convection;

said ceramic mass walls being in sufficient close proximity to said metal walls to absorb the heat from said metal walls when air flow is not established in said air passages for effective radiation of said absorbed heat into said interior space;

air outlets communicating with said air passages for delivering air outwardly into said interior space;

blower means communicating with said air passages for delivering air through said air passages and said air outlets;

heat transfer control means for controlling operation of said blower and for controlling transfer of heat into said interior space by either said convection or radiation;

said metal walls for conducting heat quickly into said air passages;

said ceramic mass walls for radiating heat in said air passages gradually and directly into said interior room space at a much slower rate than said metal walls;

said heat transfer control means for controlling said blower means having an on mode for delivering air into said interior room space and rapidly distributing and transferring said heat in said air passages by forced convection to quickly elevate the temperature of said interior space to a desired temperature; and said heat transfer control means having an off mode wherein air flow through said heat transfer air passages is terminated and heat is released and transferred directly into said interior room space by said gradual radiation of heat from said ceramic mass walls to maintan said desired temperature in said interior space in a constant and uniform manner generally without large temperature fluctuations.

2. The apparatus of claim 1 wherein said ceramic mass walls are constructed from individual brick members.

3. The apparatus of claim 2 wherein said air outlets are provided by the omission of individual ones of said brick members from said mass walls at desired locations.

4. The apparatus of claim 1 including adjustable air vane means carried in said air passages for directing the flow of air therethrough.

5. The apparatus of claim 1 including baffle means carried within said air passages defining side air passages and a rear air passage generally coextending respectively with said side and back walls of said firebox.

6. The apparatus of claim 5 wherein said baffles terminate vertically short of said top wall of said firebox.

7. A method of heating an interior room space of a building with a fuel burning heater apparatus of the type having a metal firebox wherein said fuel is burned comprising:

providing an enclosure enclosing a plurality of the walls of said firebox, said enclosure having a ceramic shell including ceramic side walls spaced from said metal side walls defining air passages therebetween into which heat from said metal walls is transferred and which may thereafter be transferred into said interior room space by forced air flow convection;

said ceramic mass walls being in sufficient close proximity to said metal walls to absorb the heat from said metal walls and air passages when air flow is not established in said air passages for effective radiation of said absorbed heat into said interior space;

providing air outlets through which air delivered through said passages may be circulated outwardly therefrom into said interior room and providing a blower means for delivering air through said passages and said outlets;

providing heat transfer control means for controlling the mode of transfer of heat into said interior room space to rapidly distribute heated air in said passageways into said interior space by means of forced convection by operation of said blower means to reach a desired room temperature; and controlling said mode of heat transfer after a desired temperature is reached in said interior space by terminating said blower means allowing heat to be distributed by radiation from said ceramic walls directly into said interior room space to maintain the level of said desired temperature in said interior room space in a constant and uniform manner without large fluctuations in the room temperature.

8. Apparatus for adapting a heater stove of the type which includes a firebox having integral metal walls into a heater stove having dual heating mode operation for heating an interior room space of a building, said apparatus comprising:

attachment frame means adapted for connection to said heater stove;

enclosure means for enclosing a plurality of said metal walls;

said enclosure means including ceramic structure supported by means of said attachment frame means in spaced relation to said firebox of said heater stove forming ceramic outer enclosure walls spaced from said metal walls of said firebox to define a plurality of air passages between respective ones of said metal and ceramic walls into which heat from said metal walls is transferred and which may thereafter be transferred into said interior room space by forced air flow convection;

said ceramic mass walls being in sufficient close proximity to said metal walls to absorb the heat from said metal walls when air flow is not established in said air passages for effective radiation of said absorbed heat into said interior space;

said metal walls for conducting heat from said firebox rapidly into said air passages;

said ceramic outer walls for radiating heat in said air passages gradually and directly into said interior room space for even heating without large fluctuations in temperature;

air outlet means disposed in said air passageways;

blower means communicating with one of said passageways for forcing air through remaining ones of said passageways outwardly through said air outlet means; and heat transfer control means for selectively operating said blower means providing a first mode of heat transfer to transfer heat rapidly from said metal walls and air passageways by forced convection for initial quick interior space heating and a second mode of heat transfer wherein forced convection is terminated and heat absorbed by said ceramic walls is radiated directly from said ceramic outer walls into said interior room space for slower, more even prolonged heating of said interior room space without large fluctuations in interior space temperature.

* * * * *